US009534424B2

(12) United States Patent
Bendel et al.

(10) Patent No.: US 9,534,424 B2
(45) **Date of Patent: *Jan. 3, 2017**

(54) ACTUATION DEVICE FOR A MOTOR VEHICLE DOOR LOCK

(71) Applicant: Kiekert Aktiengesellschaft, Heiligenhaus (DE)

(72) Inventors: Thorsten Bendel, Oberhausen (DE); Claus Toepfer, Sindelfingen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 223 days.

This patent is subject to a terminal disclaimer.

(21) Appl. No.: 14/351,792

(22) PCT Filed: Oct. 5, 2012

(86) PCT No.: PCT/DE2012/000978

§ 371 (c)(1),
(2) Date: Apr. 14, 2014

(87) PCT Pub. No.: WO2013/053347

PCT Pub. Date: Apr. 18, 2013

(65) Prior Publication Data

US 2014/0312630 A1 Oct. 23, 2014

(30) Foreign Application Priority Data

Oct. 12, 2011 (DE) ..... 20 2011 106 663 U

(51) Int. Cl.
*E05C 3/06* (2006.01)
*E05B 77/02* (2014.01)
(Continued)

(52) U.S. Cl.
CPC ..... *E05B 77/02* (2013.01); *E05B 77/06* (2013.01); *E05B 85/10* (2013.01); *Y10T 292/1075* (2015.04)

(58) Field of Classification Search
CPC .. Y10T 292/0908; E05B 77/06; Y10S 292/22; Y10S 292/65
(Continued)

(56) References Cited

U.S. PATENT DOCUMENTS 3,799,596 A * 3/1974 Nozomu ..... E05B 77/06 180/286
6,042,159 A * 3/2000 Spitzley ..... E05B 77/06 16/111.1
(Continued)

FOREIGN PATENT DOCUMENTS

EP 1 635 016 A2 3/2006

OTHER PUBLICATIONS

International Search Report for corresponding patent application No. PCT/DE2012/000978 dated Feb. 21, 2013.

*Primary Examiner* — Mark Williams
(74) *Attorney, Agent, or Firm* — Renner, Otto, Boisselle & Sklar, LLP

(57) ABSTRACT

The invention relates to an actuation device for a motor vehicle door lock (1), comprising a handle (7), and a locking lever (10) which renders the handle (7) inactive when accelerating forces (a) of a predetermined magnitude occur, for example, in the event of an accident. In the normal operation, the locking lever (10) is displaced when impinged upon by the handle (7) and the handle (7) is simply rendered inactive in the locked operation.

16 Claims, 2 Drawing Sheets

Figure 1:
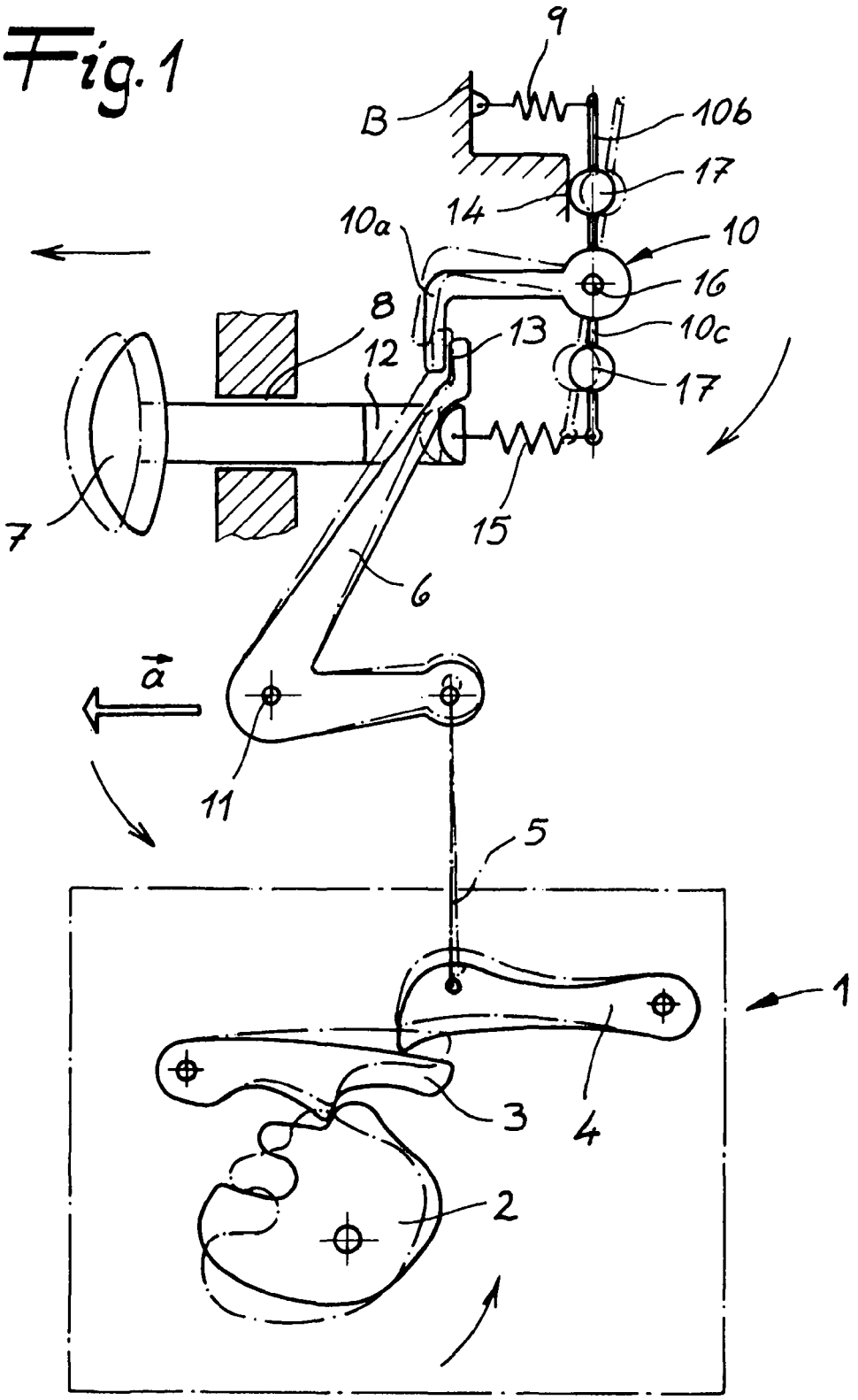

(51) Int. Cl.
*E05B 77/06* (2014.01)
*E05B 85/10* (2014.01)

(58) Field of Classification Search
USPC ..... 292/195, 336.3, DIG. 22
See application file for complete search history.

(56) References Cited

U.S. PATENT DOCUMENTS

| | | | | |
|---|---|---|---|---|
| 8,029,032 | B1 * | 10/2011 | Yang | E05B 77/06 292/336.3 |
| 2006/0038417 | A1 | 2/2006 | Pudney | |
| 2007/0024068 | A1 | 2/2007 | Wood | |
| 2009/0322105 | A1 | 12/2009 | Lee et al. | |
| 2010/0237634 | A1 | 9/2010 | Gandhi | |
| 2011/0163554 | A1 | 7/2011 | Patel | |

* cited by examiner

ACTUATION DEVICE FOR A MOTOR VEHICLE DOOR LOCK

The invention relates to an actuation device for a motor vehicle door lock comprising a handle and a locking lever, which renders the handle ineffective when accelerating forces of a predetermined magnitude occur, for example in the event of an accident.

The actuation device is usually mechanically coupled to the motor vehicle door lock via a connecting means, such as a Bowden cable, an actuating rod, etc. In the simplest arrangement the handle thus impinges a release lever inside the motor vehicle door lock. This release lever regularly lifts a pawl from a rotary latch so that the rotary latch opens with the aid of a spring and releases a previously retained locking bolt. As a result, the motor vehicle door lock is opened and an associated motor vehicle door can also be pivoted open or opened in any other manner.

The locking lever is provided to prevent unintentional opening, for instance in case of an accident. To achieve this, the locking lever renders the handle ineffective when accelerating forces of a predetermined magnitude occur in the event of an accident. Due to the effect of the locking lever this means that the respective accelerating forces do not result in the motor vehicle door lock being unintentionally opened. As a result, passengers inside the vehicle body are offered maximum protection and safety devices inside the car, such as side impact protection, airbags, etc. are able to become fully effective.

The generic prior art according to DE 199 49 119 A1 provides a spherical control element.

The control element in turn acts on a securing part engaging in a groove-like recess in the event of a crash, blocking the handle.

The prior art based on the also generic DE 199 10 513 A1 discloses a similar design. In this case a locking lever is provided that interacts with a fixed counter-blocking surface. In the event of a crash and the resulting inertia forces, the locking lever moves into a blocking position locking the door handle.

Reference should also be made to the door lock disclosed in DE 2 023 859, used in particular for motor vehicles. This lock contains a pulling handle and a means activated by inertia. The pulling handle contains a shaft extending through an external door panel into the inside of the door. Inside the door, a balancing mass is pivotally arranged in such a way that in the event of a sudden change of the direction of movement against the external door panel, pivoting of the pulling handle in opening direction is prevented.

Prior art has generally proven to be successful but does have its limits if the locking lever has not been operated for a long time. Today the service life of vehicles is increasing with vehicles often lasting for more than 10 years. In designs based on prior art it is difficult to guaranty the functioning of the locking lever even after a considerable time. This is due to the fact that the locking lever is normally arranged in the area of an external door handle or an actuation device located at this point and is thus more or less exposed to weather effects, corrosion, etc. Such a design cannot guaranty that even after several years the desired and correct functioning is ensured and that passengers are offered the best possible protection in the event of an accident. The invention aims to remedy this situation.

The invention is based on the technical problem of further developing an actuation device for a motor vehicle door lock with the design described above in such a way that a permanent reliable functioning that is guaranteed for many years, can be provided.

To solve this technical problem a generic actuation device of the invention is characterized by the locking lever being deflected during normal operation when the handle is acted upon and only rendering the handle ineffective in the locked operation.

According to the invention the normal operation consequently corresponds to the locking lever being deflected when the handle is acted upon once or every time it is acted upon. In general, each activation of the handle consequently also causes the locking lever to be deflected. Every time the external door handle or the handle provided in this area is, for instance activated by a user for opening the respective vehicle door or is acted upon in any other way, the locking lever is deflected at the same time. This ensures that the respective bearings for the in most cases pivotally arranged locking lever cannot "stick" as a result of corrosion or, in the worst case, "seize up due to rusting". Instead, the constant and regular acting upon of the locking lever ensures that it retains its function even in the event of a long service live of the vehicle and thus of the respective door lock as well as of the actuation device.

The locking lever thus ensures in the locked operation, i.e. typically in the event of accelerating forces resulting from an accident, that the function of the handle becomes ineffective. This also means that any accelerating forces applied to the handle do not result in a deflection of the handle or in an ineffective deflection and consequently also do not cause the release lever to be activated in the connected motor vehicle door lock. An associated motor vehicle door lock is thus not inadvertently opened.

The ineffectiveness of the handle in the locked operation can also be set up in such a way that the handle more or less carries out or can carry out an empty stroke in relation to the respective release lever, initiated by the locking lever in the locked operation. In general, the locking lever does, however, block the handle in the locked operation. For this purpose, the locking lever advantageously contains at least two masses of inertia. The locking lever is also generally arranged to be pivotable around an axis of rotation.

The at least two masses of inertia are in most cases arranged on both sides of the axis of rotation at, in each case, one arm of the locking lever. One design in particular has proven to be advantageous in which the locking lever is balanced a regards the torques applied to its axis of rotation. This means that any force applied to the locking lever as a whole, i.e., a force applied to all arms does, according to the invention, not cause the locking lever to carry out a rotary movement around its axis of rotation. Instead, the locking lever is not affected by such forces. These forces are typically generated as inertia forces in the event of an accident.

As the locking lever is balanced a regards the torques applied to its axis of rotation, the locking lever remains at rest. In most cases this position is even more defined or fixed by the fact that at least one of the two arms is designed as an inertia arm abutting a stop. This means that in case of accelerating forces associated with an accident, the locking lever remains in its rest position, characterized by the fact that the inertia arm rests against the stop.

As according to another advantageous embodiment the locking lever contains a stop arm which interacts, where applicable, with the handle this resting position of the locking lever ensures that in case of a deflection of the locking lever, the handle is held back or blocked or can be blocked.

Due to the arrangement of the inertia masses at the locking lever, the locking lever contains a considerable inertia so that it is not rotated when accelerating in any direction and that it remains in the respective resting position as long as no torque is applied to one of the at least two arms, in order to move the locking lever (slowly) around its axis of rotation. This is the case in normal operation, in which the handle ensures that the locking lever is deflected as already described.

Each (fast) movement deviating from such a (slow) movement of the handle is, however, not able to deflect the locking lever. In such a case it is instead apparent that due to its considerable inertia, the locking lever stays in position or retains its resting position. As a result ultimately also "too quick pulling" of the handle will cause the locking lever not to be deflected and to retain its rest position. This will ultimately block the handle.

Generally the arrangement will in this context be designed in such a way that such "too quick" pulling of the handle is always associated with an accident and cannot be produced by an operator during normal operation. This means that as of a certain specified accelerating value of the handle the locking lever coupled to said handle can no longer follow due to its activity. For this purpose the locking lever is generally elastically coupled to the handle. To achieve this, the locking lever typically contains a coupling arm connected to the handle by means of a spring. The coupling arm is one of the two arms supporting the respective inertia mass. This means that the arms are on one hand designed as inertia arms and, on the other hand, as coupling arms. In addition, the respective masses are co-linear, i.e. they are arranged on a common linear axis through the pivoting point. In contrast, the stop arm generally has an angled design and can, in particular, be arranged at right angles to this axis.

In a further embodiment, not shown, also several masses can be arranged, which are each arranged on axes extending through the pivoting point.

Finally, the handle also has a resetting means, ensuring that the handle after a pulling or other motion suitable for acting upon the motor vehicle door lock returns to its original position. The resetting means is generally connected to the locking lever. Usually the resetting device is a spring elastically coupling the inertia arm to a base. The base can be an element of the motor vehicle door, such as an external door panel, an internal door panel or similar.

The figures show an actuation device for a motor vehicle door lock 1. The basic design of the motor vehicle door lock 1 contains a locking mechanism 2, 3 comprising a rotary latch 2 and pawl 3. A release lever 4 acts on the pawl 3. The release lever 4 is connected to a deflection lever 6 via a flexible connecting means or a Bowden cable 5, said lever being acted upon by a handle 7.

The handle 7 runs through a duct 8 to extend through an external door panel of a motor vehicle door—not shown in detail—which also functions as a base B explained in further detail below. If the handle 7 is acted upon by a user pulling the handle in the direction of the arrow shown in the figures, this movement causes the deflection lever 6 to be pivoted around its axis 11 in counterclockwise direction. This results in a pulling force acting on the Bowden cable 5, which as a result pivots the release lever 4 in clockwise direction. This in turn lifts the pawl 3 off the rotary latch 2, which moves into the opening position with the aid of a spring and releases a locking bolt previously retained. This changeover during normal operation of the motor vehicle door lock 1 from the closed position shown in FIG. 1 into the open position is apparent when comparing the closed position depicted in FIG. 1 with the open position shown in FIG. 2. The open position or the changeover is also indicated by the dashed/dotted line in FIG. 1.

Figure 2:
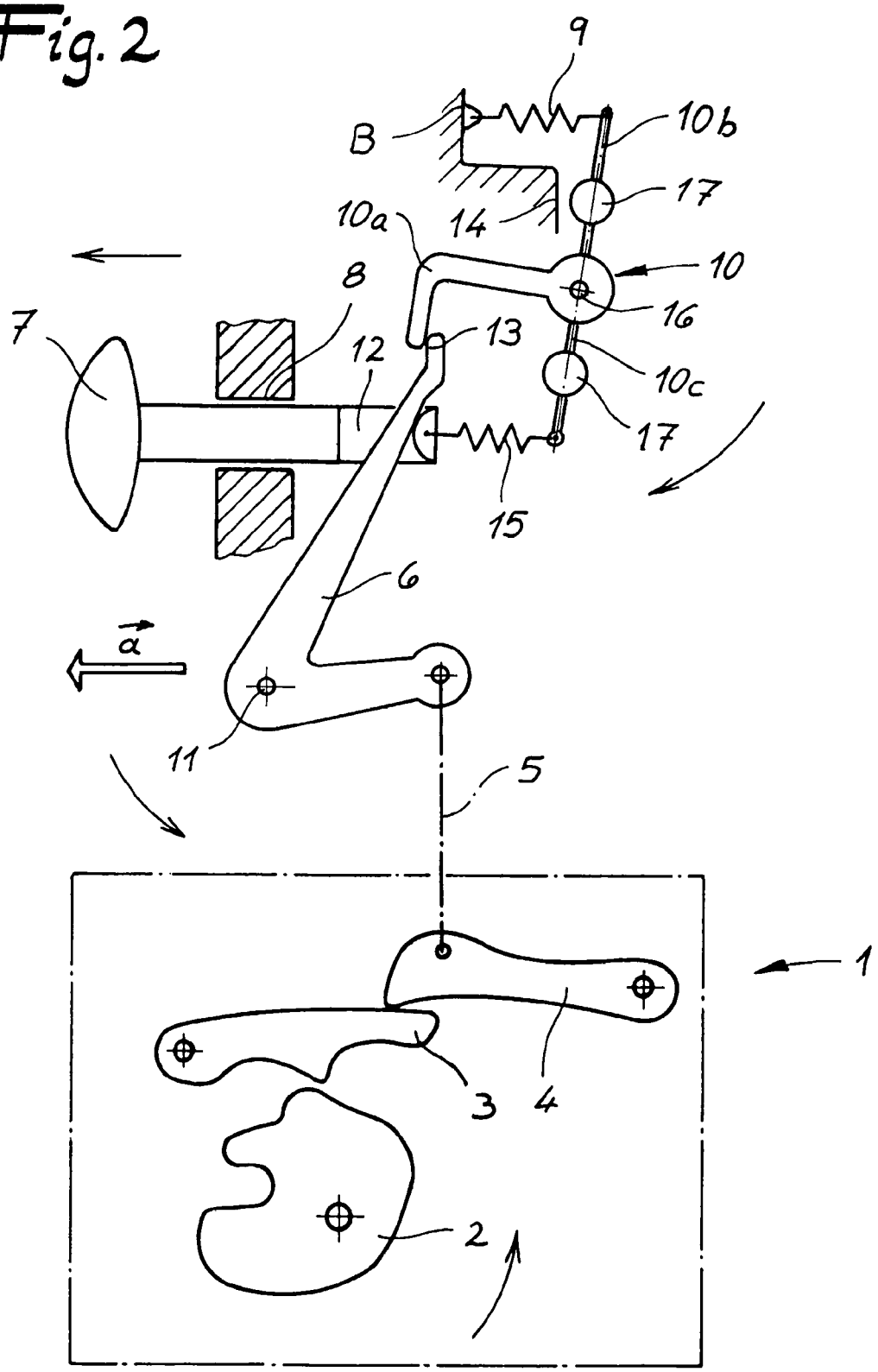

After the handle 7 has been acted upon by pulling, it returns into its original position as shown by the continuous line in FIG. 1. This is achieved by a return spring 9 or generally a resetting means 9. The resetting means or the return spring 9 is connected to a locking lever 10. The resetting means 9 or the return spring 9 provided at this point actually elastically connects the respective locking lever 10 to the aforementioned basis B or the motor vehicle door.

Apart from the handle 7 and the motor vehicle door lock 1, the aforementioned locking lever 10 represents a further main element of the actuation device according to the invention, as the locking lever 10 renders the handle 7 ineffective when accelerating forces of a predetermined magnitude occur, for example, in the event of an accident. The respective accelerating forces are illustrated in more details in the Figures by the arrow labeled $\bar{a}$. In the example the respective accelerating forces $\bar{a}$ are produced by a side impact, although the invention is naturally not limited to this. In such a case or in a locked operation, the locking lever 10 ensures that the handle 7 is blocked. This is shown in FIG. 1.

In the embodiment, the locking lever 10 is a three-arm lever. The locking lever 10 actually contains an L-shaped stop arm 10*a*. The stop arm 10*a* can interact with the handle 7 or the deflection lever 6, where applicable. The deflection lever 6, pivotally mounted around the axis of rotation 11, actually extends through a recess 12 in the handle 7 and a stop 13 interacting with the stop arm 10*a* of the locking lever 10 where applicable.

Apart from the stop arm 10*a*, the locking lever 10 also contains an inertia arm 10*b* and a coupling arm 10*c*. In the resting state of the locking lever 10, the inertia arm 10*b* lies against a stop 14. The coupling arm 10*c* is elastically connected to the handle 7 by means of a spring 15. In this way, the locking lever 10 is connected to handle 7 via spring 15.

The locking lever 10 as a whole can be pivoted around an axis 16 and in normal operation, in clockwise direction, as indicated by an arrow in FIG. 1. The locking lever 10 also contains two masses of inertia 17. The two masses of inertia 17 are arranged on both sides of the axis of rotation 16 of the locking lever 10. All in all the design is such that the locking lever 10 is balanced as regards the torques applied to its axis of rotation 16.

So when the indicated accelerating forces $\bar{a}$ are applied in the shown direction to the door lock 1, the handle 7 and naturally also the locking lever 10, these accelerating forces $\bar{a}$ do not cause the locking lever 10 to be pivoted around its axis 16. Instead the locking lever 10 remains in its rest state due to the two masses of inertia 17 in which the inertia arm 10*b* rests against stop 14 and thus ensures the rest state in this way. This is also aided by the interaction of, on one hand, the return spring 9 abutting one end of the inertia arm 10*b* and, on the other hand, the spring 15, elastically connecting the coupling arm 10*c* to the handle 7.

The two arms 10*b*, 10*c* supporting the respective masses of inertia 17 are each co-linear, i.e. are arranged linearly on one axis. In contrast, the stop arm 10*a* is an angled arrangement. In the embodiment, the stop arm 10*a* is connected at right angles to the other two arms 10*b*, 10*c*. The arrangement functions as follows.

Starting from the normal operation shown by the continuous line in FIG. 1, i.e. in case that accelerating forces $\bar{a}$ produced in the event of an accident are applied, the pulling of the handle 7 in the direction indicated by the arrows ensures on one hand that the deflection lever 6 is moved in counterclockwise direction with the already described consequences. At the end of this movement the locking mechanism 2, 3 is open. On the other hand this process also causes the stop 13 on the deflection lever 6 to interact with the stop arm 10*a* of the locking lever 10. As a result, the locking lever 10 is pivoted around its axis 16 in clockwise direction as indicated and can act on the handle 7 and the deflection lever 6 in such a way that the locking mechanism 2, 3 is indeed opened as described and can also be opened. In contrast, the locked operation corresponds to the handle 7 being blocked by the stop arm 10*a*, as the locking lever 10 is not pivoted around its axis 16 in this locked operation. This means that the locking lever 10 blocks the handle 7 in the locked operation. Alternatively, the spring 15 can also ensure that the handle 7 is not deflected in the locked operation.

Such a locked operation can be observed as soon as significant accelerating forces $\bar{a}$ are applied. Typically this can occur or can be the case in the event of an accident. In this case the balanced design of the locking lever 10 as regards the torque applied to its axis of rotation 16 ensures that the locking lever 10 retains it rest position shown as a continuous line in FIG. 1. This means that the locking lever 10 has a respective inertia provided by the two masses of inertia 17. Any possible and quick pulling movement on the handle 7 in the direction of the arrow shown in FIG. 1 is consequently not implemented, as either the spring 15 coupling the handle 7 with the locking lever 10 retains the handle 7 or as the stop 13 of the transmission lever 6 carried along by the handle 7 is retained by the stop arm 10*a* of the locking lever 10 and is blocked.

The invention claimed is:

1. An actuation device for a motor vehicle door lock moveable between an unlocked position and a locked position, the actuation device comprising:

a handle actuatable during a normal operation for unlocking the door lock;

a deflection lever pivotally connected about an axis between the door lock and the handle, wherein the deflection lever pivots about the axis to move the door lock from the locked position to the unlocked position; and a locking lever having an inertia arm and a stop arm that extends from the inertia arm, the locking lever being engageable with the deflection lever, wherein in response to an acceleration force of greater magnitude than a force of the normal operation for unlocking the door lock, the stop arm is in a rest position where the stop arm rests against the deflection lever to prevent the deflection lever from pivoting, a moment of inertia of the inertia arm preventing movement of the stop arm, and wherein when the handle is actuated during the normal operation, the handle acts on the deflection lever to pivot the deflection lever to unlock the door lock and to displace the stop arm from the rest position.

2. The actuation device according to claim 1, wherein the locking lever is configured to pivot around an axis of rotation.

3. The actuation device according to claim 1, wherein the locking lever contains at least two masses of inertia.

4. The actuation device according to claim 3, wherein at least one of the masses of inertia is located along the along the inertia arm and the masses of inertia are disposed on opposite sides of the axis of rotation of the locking lever.

5. The actuation device according to claim 1, wherein the deflection lever includes a stop and the inertia arm abuts the stop when the door lock is in the locked position.

6. The actuation device according to claim 1, wherein the locking lever contains a coupling arm interacting with the handle.

7. The actuation device according to claim 6, wherein the inertia arm and the coupling arm are arranged in a co-linear manner.

8. The actuation device according to claim 7, wherein the stop arm is arranged at a right angle to the inertia arm and the coupling arm.

9. The actuation device according to claim 8, wherein the stop arm, the inertia arm, and the coupling arm are fixed relative to one another and uniformly rotate about an axis.

10. The actuation device according to claim 8, wherein the stop arm is L-shaped for engaging with the deflection lever.

11. The actuation device according to claim 6, wherein the coupling arm of the locking lever is elastically coupled to the handle.

12. The actuation device according to claim 11, wherein the coupling arm of the locking lever is connected to the handle via a spring.

13. The actuation device according to claim 6, wherein the coupling arm and the inertia arm each support a respective mass of inertia.

14. The actuation device according to claim 1, wherein the handle contains a resetting means.

15. The actuation device according to claim 14, wherein the resetting means is connected to the locking lever.

16. The actuation device according to claim 14, wherein the resetting means is a spring elastically coupling the inertia arm to a base of a motor vehicle door.

* * * * *